US005740744A

United States Patent [19]

Nashirozawa et al.

[11] Patent Number: 5,740,744

[45] Date of Patent: Apr. 21, 1998

[54] THROUGH-WALL TYPE AUTOMATIC CUSTOMER SERVICE APPARATUS

[75] Inventors: Kenichi Nashirozawa; Michinori Kawano; Kazushi Watari; Shuetsu Oikawa; Hiroyuki Moto; Setsuko Yamamoto, all of Kawasaki, Japan

[73] Assignee: Fujitsu Limited, Kawasaki, Japan

[21] Appl. No.: 506,771

[22] Filed: Jul. 26, 1995

[30] Foreign Application Priority Data

| | | | |
|---|---|---|---|
| Nov. 29, 1994 | [JP] | Japan | 6-294284 |
| Nov. 29, 1994 | [JP] | Japan | 6-294285 |
| Nov. 29, 1994 | [JP] | Japan | 6-294286 |
| Nov. 29, 1994 | [JP] | Japan | 6-294287 |

[51] Int. Cl.[6] ..... G07H 9/00

[52] U.S. Cl. ..... 109/24.001; 235/379; 902/30

[58] Field of Search ..... 109/24.1; 235/379; 902/30–36

[56] References Cited

U.S. PATENT DOCUMENTS

| | | | |
|---|---|---|---|
| 2,897,534 | 8/1959 | Pickerell | 292/263 |
| 3,064,846 | 11/1962 | Thomas | 292/263 |
| 3,480,247 | 11/1969 | Waner | 292/275 |
| 4,595,828 | 6/1986 | Lundblad | 235/379 |
| 5,017,026 | 5/1991 | Takesako et al. | 235/379 |
| 5,024,073 | 6/1991 | Lloyd | 70/34 |
| 5,071,180 | 12/1991 | Wiedehage et al. | 292/268 |
| 5,222,445 | 6/1993 | Capraro | 109/24.1 |
| 5,299,511 | 4/1994 | Dallman et al. | 109/24.1 |
| 5,483,047 | 1/1996 | Ramachandran et al. | 235/379 |
| 5,553,552 | 9/1996 | Bauer et al. | 109/24.1 |

FOREIGN PATENT DOCUMENTS

| | | | |
|---|---|---|---|
| 2812894 | 10/1979 | Germany | 292/268 |

*Primary Examiner*—Darnell M. Boucher
*Attorney, Agent, or Firm*—Staas & Halsey

[57] ABSTRACT

A through-wall type automatic customer service apparatus is arranged in a partition wall in a financial institution. The body of the apparatus has a facade which passes through an aperture in the wall and is exposed to the outside of the wall, for operation by users. The facade is pivotably attached to the body and is movable between an open position and a closed position. A locking screw can lock the facade in the closed position and can be operated from the outside of the body in the wall. The apparatus also includes support arms for supporting the facade in the open position.

28 Claims, 14 Drawing Sheets

THROUGH-WALL TYPE AUTOMATIC CUSTOMER SERVICE APPARATUS

BACKGROUND OF THE INVENTION

1. Field of the Invention

The present invention relates to an automatic customer service apparatus arranged in branches of financial institutions for operation by users, such as an automatic tellers machine (ATM) or a cash dispenser (CD) for depositing or withdrawing money. In particular, the present invention relates to a through-wall type automatic customer service apparatus arranged inside a wall in a building structure.

2. Description of the Related Art

A through-wall type automatic customer service apparatus has a body containing mechanical and electrical components therein and having a facade functioning as a front cover. The facade is fixedly attached to the body. The body of the apparatus is arranged in wall such as a vertical partition wall in a building structure or an outer vertical wall of a building structure, and the facade is passed through an aperture in the wall so as to be exposed outside the wall. A CRT display, function keys, a keyboard, a cash inlet/outlet, a card insertion hole, a receipt outlet, and so on appear in (i.e.,are disposed on) the front surface of the facade. Users can operate these components for depositing or withdrawing money.

The components contained in the body of the apparatus are, for example, a control unit, CRT displays, a bill dispenser unit, printers, keyboards and conveyors. The body is fundamentally a casing for accommodating these units therein, and a door is provided at the rear of the body to obtain access to the parts.

When maintenance is to be carried out on components in the body of the apparatus, the door at the rear of the body is opened, and components in the body can be inspected from the rear of the body, or components in the body can be inspected after components are slidably drawn rearwardly from the body. It is easy to obtain access to the units located at the rear or at an intermediate position in the body, but it is not easy to obtain access to the units located at the front of the body because the units located at the front of the body correspond to units located at the innermost position in the body when viewed from the door. Therefore, it is possible to access the units located at the front of the body only after almost all the units are withdrawn to the rear, since the facade is fixed to the body and cannot be opened. This also applies to components arranged on the rear surface of the facade. Therefore, in the conventional through-wall type automatic customer service apparatus, maintenance of the units located at the front of the body and of the rear surface of the facade is time- and labor-consuming and less effective.

In addition, a problem occurs, regarding the receipt outlet, when the apparatus is arranged so that the facade is exposed to the outside of the outer wall of the building structure and is subjected to rain and snow. Since the receipt outlet extends generally horizontally and is formed by a vertical wall component, rain or snow may enter the receipt outlet and the components in the facade may become wet. In some cases, the components of the facade can be seen from the outside, through the receipt outlet, and the receipt outlet may be tampered with.

In addition, another problem occurs when the body of the through-wall type automatic customer service apparatus includes a CRT display. The facade has a portion called a display panel having an opening through which the CRT display appears (i.e., is exposed and thereby visible) to the outside. The peripheral wall around the opening of the display panel rests against the surface (display surface) of the CRT display, so the peripheral region of the display surface is hidden. To allow the display panel to exactly rest against the CRT display, it is necessary that the curvature of the display surface of the CRT display is identical to the curvature of the surface of the display panel.

If the curvature of the display surface of the CRT display is different from the curvature of the surface of the display panel, it is not possible to exactly rest the display panel against the CRT display. In many cases, manufacturers provide CRT displays having the display surfaces with different curvatures, so it is necessary to prepare a facade with a display panel adapted for every CRT display and the manufacturing cost increases. Therefore, it is requested to provide an automatic customer service apparatus with a standard facade for every CRT display.

SUMMARY OF THE INVENTION

The object of the present invention is to solve the above described problems and to provide a through-wall type automatic customer service apparatus in which maintenance can be efficiently carried out from the outside (i.e., exterior surface) of a wall.

Another object of the present invention is to provide a through-wall type automatic customer service apparatus having a receipt outlet through which rain and snow cannot enter the receipt outlet and the inside of the facade cannot be seen, from the outside of the facade, through the receipt outlet.

Still another object of the present invention is to provide a through-wall type automatic customer service apparatus having a CRT display and a standard display panel provided in a facade.

According to the present invention, there is provided a through-wall type automatic customer service apparatus comprising a body containing mechanical and electrical components therein and having a facade functioning as a front cover, said body being arranged inside a wall having an aperture therethrough so that the facade is exposed to the outside of the wall through the aperture in the wall for operation by users, and the facade being, movable relatively to the body, to the outside of the wall between an open position and a closed position.

Preferably, the facade is pivotably attached at one end thereof to the body by a generally horizontal hinge, and locking means is provided for locking said facade to the body in the closed position. The locking means is preferably arranged so that it can be operated from the outside of said body in the wall. The locking means may comprise an engaging member attached to the facade, a corresponding engaging member attached to the body, and a screw connecting the engaging members.

Preferably, the facade is pivotably attached at its lower end or at its upper end thereof to the body.

Preferably, the facade has a top, opposite sides and a bottom, and said body includes a front frame portion having vertically extending opposite side panels which can be inserted in the aperture of the wall to at least partly house said facade therein.

Preferably, the hinge is located at a front and bottom position of the facade and the front frame portion. In this case, the facade preferably has a front and bottom wall formed so as to surround the hinge.

Preferably, the apparatus further comprises support arms extending between the sides of the facade and the side panels of the front frame portion of the body, respectively, for supporting the facade in the open position. In this case, the support arms preferably have respective, different lengths.

Preferably, the body contains a receipt printer and a receipt conveyor and the facade has a receipt outlet for delivering a receipt printed by the receipt printer and conveyed by the receipt conveyor, the receipt outlet being formed by parallel upper and lower wall members, the upper wall member including a jaw at the bottom thereof, the jaw extending obliquely outwardly relative to the lower wall member.

Preferably, the body contains a CRT display having a display surface, and the facade has a display panel having an opening, an annular adapter being interposed between the display surface and the display panel so that the display panel is urged to a peripheral region of the display surface via the adapter. Preferably, the adapter has a first surface on the side of the CRT display and a second surface on the side of the display panel, the first surface having a curvature identical to a curvature of the CRT display to be used, the second surface having a curvature identical to a curvature of the display panel.

Preferably, the apparatus further comprises at least one gas (hydraulic) spring extending between a side of the facade and a side of the body for supporting the facade in the open position, the gas spring comprising a cylinder and a rod accommodated in and extendable from the cylinder. In this case, preferably, the gas spring includes a stopper to lock the gas spring in the open position. The cylinder of the gas spring is located higher than the extended rod when in the open position, and the stopper includes an engaging portion which engages a lower end of the cylinder when in the open position, and releasing means to release the engagement.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
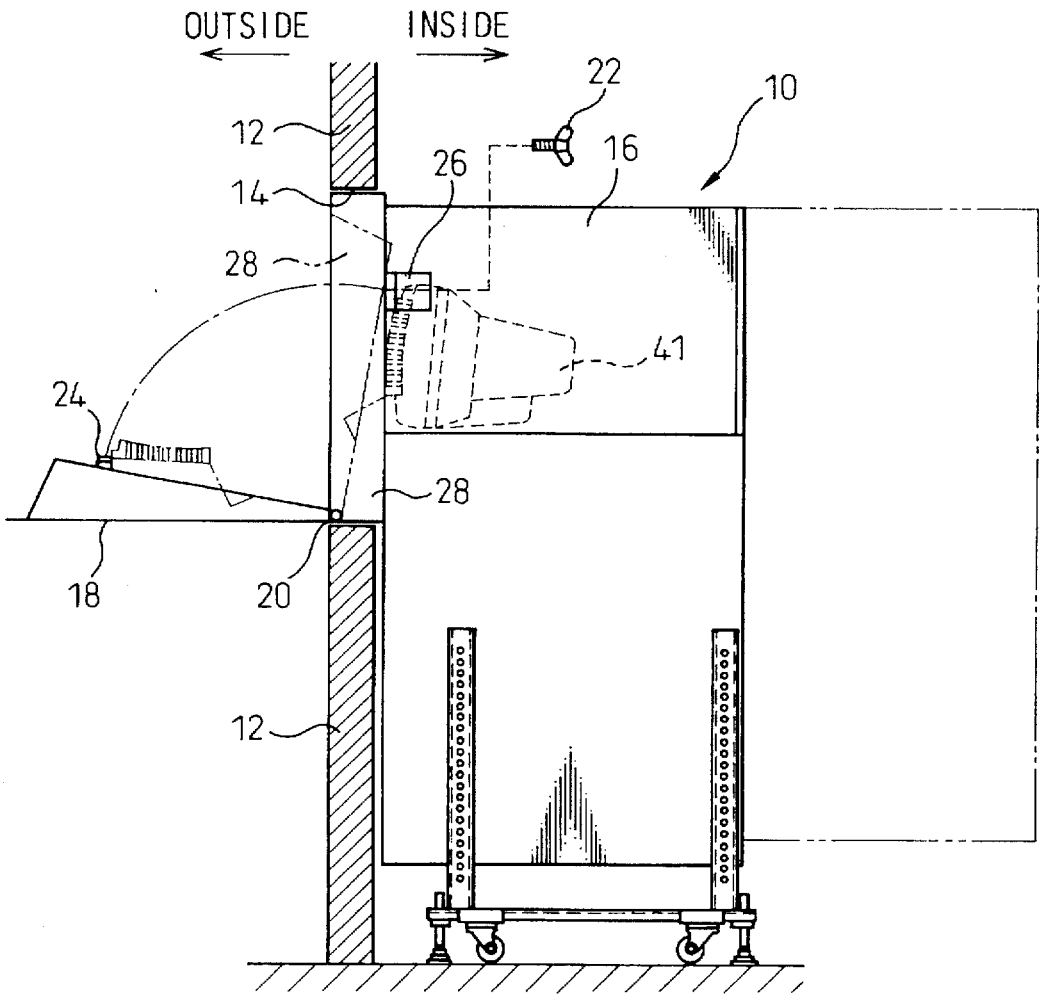
FIG. 1 is a diagrammatic cross-sectional view of a through-wall type automatic customer service apparatus according to the first embodiment of the present invention.

FIG. 1 shows the through-wall type automatic customer service apparatus according to the first embodiment of the present invention. The through-wall type automatic customer service apparatus 10 may be an ATM or a CD arranged in an enclosure, e.g., a branch office of a financial institution accessible from the exterior of the enclosure for operation by users to deposit or withdraw money. More specifically, the apparatus 10 is arranged inside a wall 12 having interior and exterior surfaces and separating the enclosure ("INSIDE") from the exterior ("OUTSIDE"), the wall 12 having an aperture 14 extending therethrough. The apparatus 10 comprises a body 16 having a facade 18 functioning as a moveable front cover.

The body 16 is arranged contiguous the interior of the wall 12 so that the facade 18 passes through the aperture 14 and is exposed outside the wall 12 for operation by the user of the apparatus 10. The facade 18 is pivotably attached to the body 16 by a hinge 20 having a horizontal axis and is selectively movable through the aperture 14 and extending, outside the wall 12, to an open position (shown in solid line) exposing the interior of the apparatus 10 through the aperture 14, and to a closed position (shown in broken line), substantially within the apertures 14, covering the interior of the apparatus 10.

The facade 18 is locked to the body 16 in the closed position by locking means in the form of a screw 22. An engaging member 24 having a threaded hole is attached to the rear surface of the facade 18 and a corresponding engaging member 26 having a through hole is attached to the body 26. The screw 22 is passed through the through hole of the engaging member 26 and driven into the threaded hole of the engaging member 24 to fix the facade 18 to the body 16 when the facade 18 is closed. It will be clear that the facade 18 can be opened after the screw 22 is released. The screw 22 can be operated from the outside of the body 16 and inside the wall 12.

Figure 2:
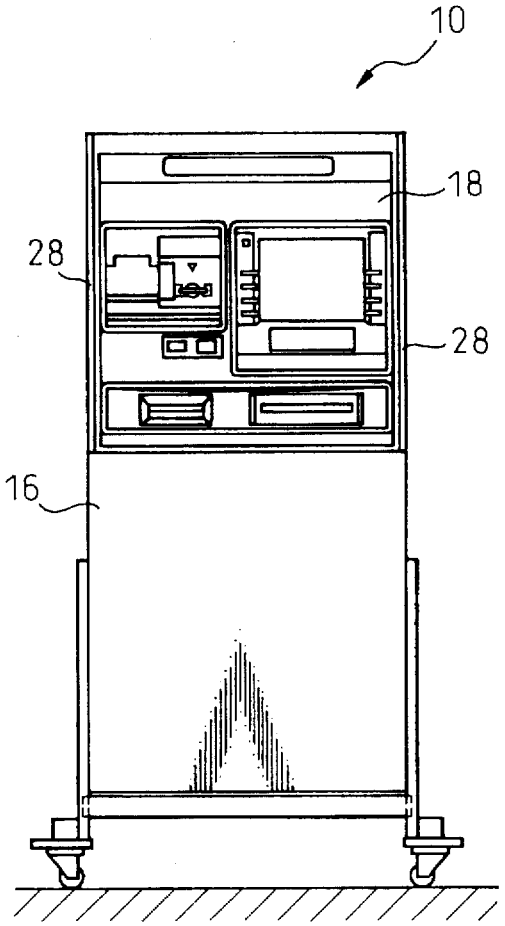
FIG. 2 is a front view of the automatic customer service apparatus of FIG. 1, with the wall omitted.
Figure 3:
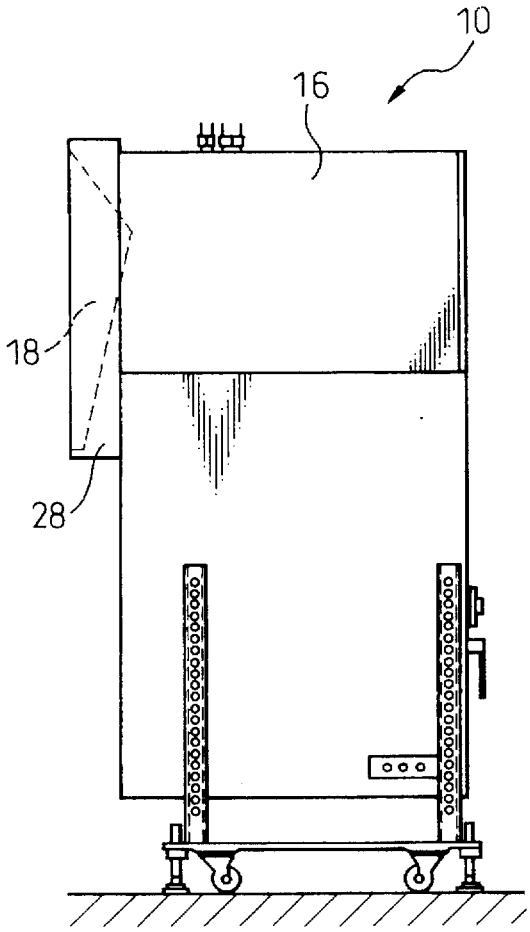
FIG. 3 is a side view of the automatic customer service apparatus of FIG. 2.

As shown in FIGS. 1 to 3, the body 16 of the apparatus 10 is substantially a casing in which several mechanical and electrical units are housed. A CRT display 41 is shown in FIG. 1, the other units being described below. The body 16 also includes a front frame portion in the form of vertically extending opposite side panels 28*a* which can be inserted into the aperture 14 of the wall 12. The facade 18 has a generally rectangular profile with a top side, opposite vertical sides and a bottom side, and is housed at least partly in the front frame portion 28.

Figure 4:
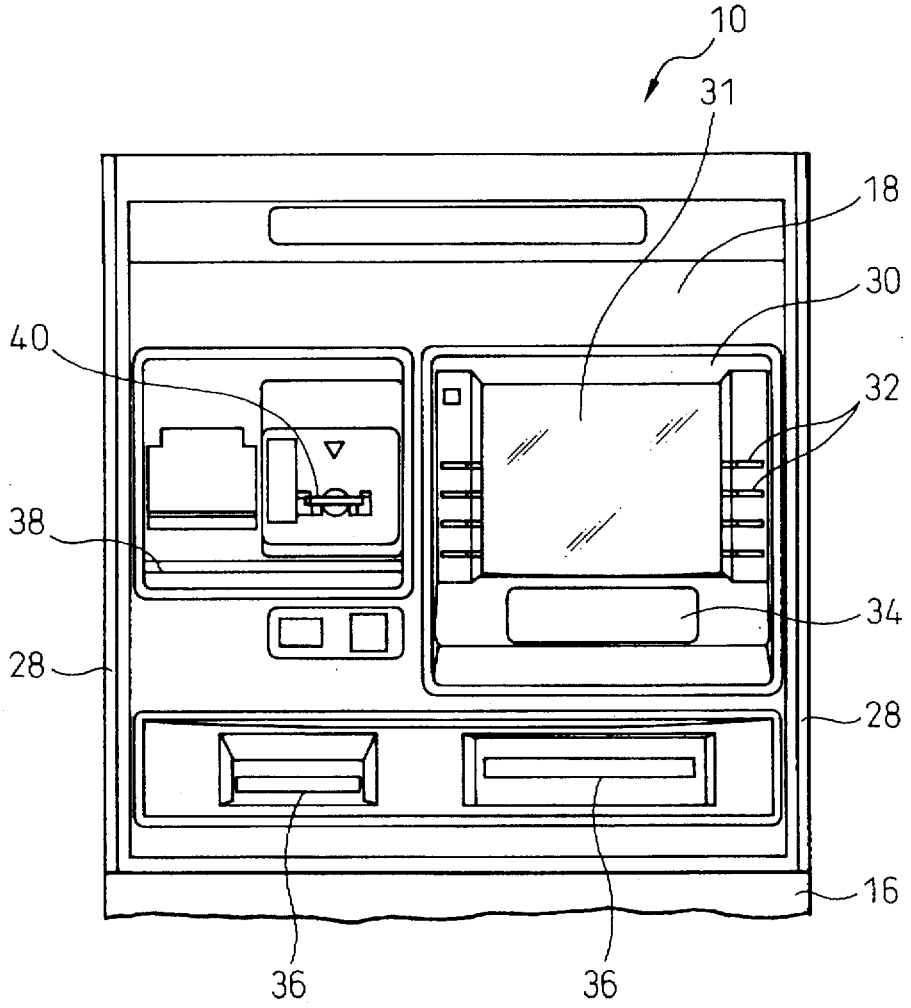
FIG. 4 is an enlarged view of a portion of the apparatus of FIG. 2.

The facade 18 has, as a part thereof, a display panel 30 having an opening 31 through which the CRT display 41 can be seen, as shown in FIG. 4. The display panel 30 also has small holes 32 through which function keys (not shown) appear and an opening 34 through which a keyboard (not shown) appears. The facade 18 also has cash inlets/outlets 36, a receipt outlet 38, and a card insertion hole 40.

Figure 13:
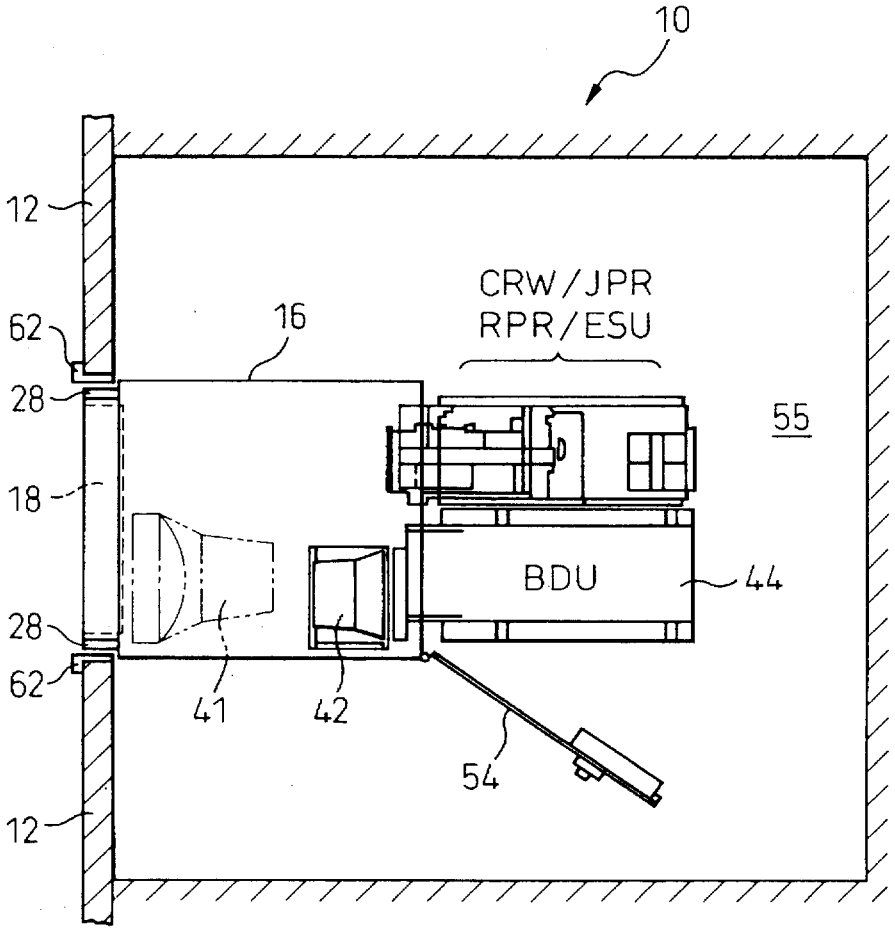
FIG. 13 is a horizontal cross-sectional view of the apparatus, illustrating main units contained in the body of the apparatus.
Figure 14:
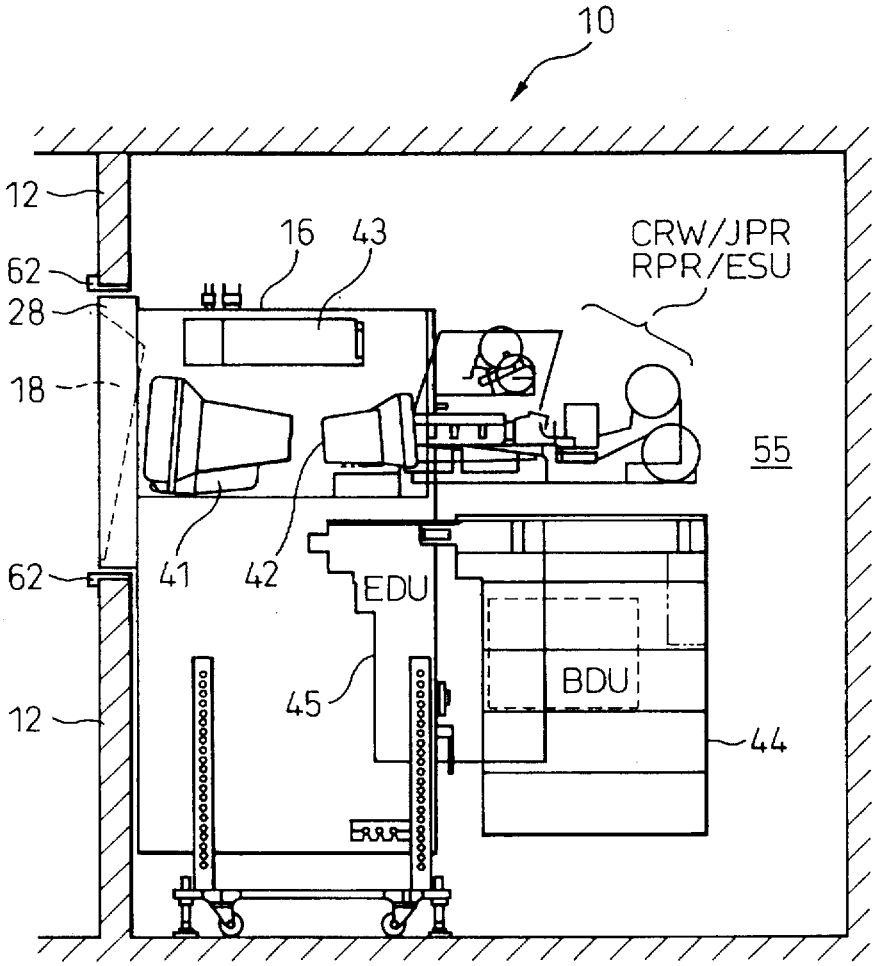
FIG. 14 is a vertical cross-sectional view of the apparatus of FIG. 13.
Figure 15:
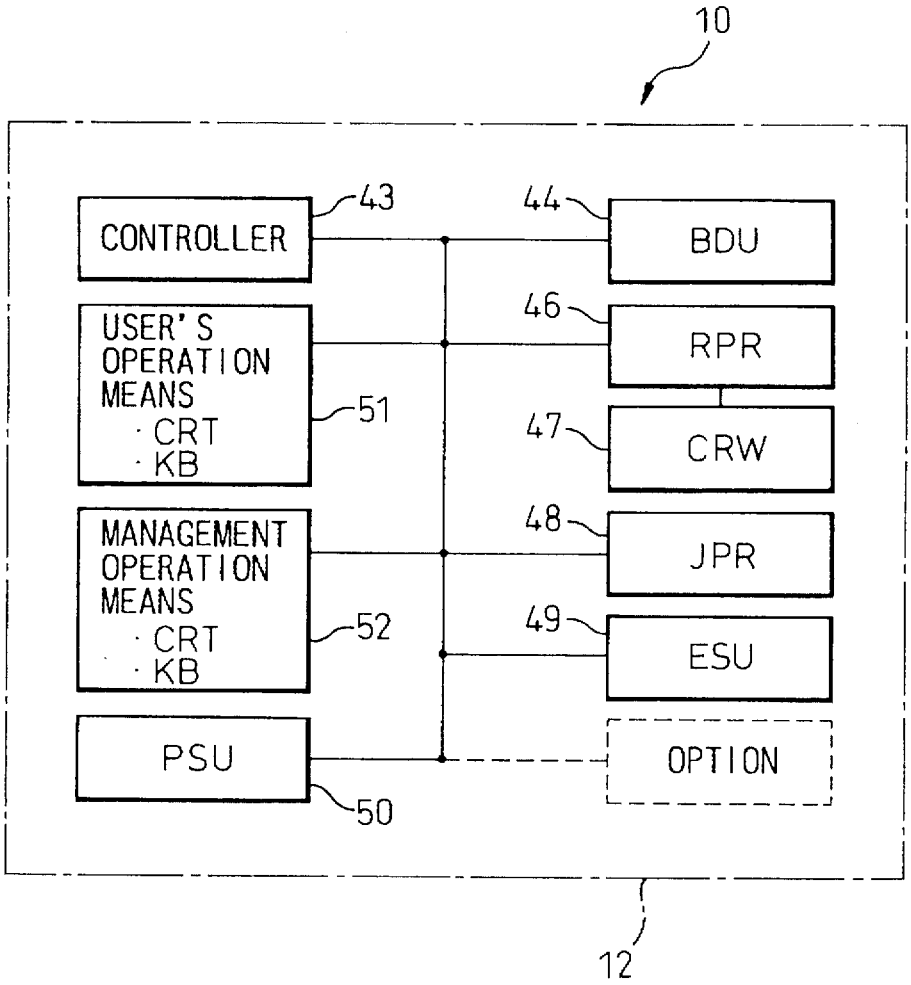
FIG. 15 is a block diagram of the main units of FIGS. 13 and 14.

As shown in FIGS. 13 to 15, the body 16 of the apparatus 10 contains therein a keyboard (not shown), the CRT display 41, a second CRT display 42, a controller 43, a bill dispenser unit (BDU) 44, an envelope depository unit (EDU) 45, a receipt printer (RPR) 46, a card reader/writer (CRW) 47, a journal printer (JPR) 48, an envelope supply unit (ESU) 49, a power supply unit (PSU) 50, and other options. RPR 46, CRW 47, JPR 48, and ESU 49 are carried as a unit on slides. User's operation unit 51 comprises the keyboard (KB) and the CRT Display 41(CRT) for operation by a user, and the management operation unit 52 comprises another keyboard and the second CRT Display 42 (CRT) for operation by an operator. In addition, there are conveyors (not shown) for conveying cash and receipts. These and other units or components can be drawn to the rear of the body 12.

The body 16 has a door 54 (FIG. 13) and the maintenance of the parts must be carried out in the space 55 which is located on the rear side of the body 16 and far from the front of the body 16 and the facade 18. According to the present invention, it is possible to carry out the maintenance of the parts located at the front position of the body 16 and of the parts located on the rear surface of the facade 18 such as shutters, from the outside of the wall 12 by opening the facade 18. When the maintenance of the parts located at the rear and intermediate positions in the body 16 is carried out, it is not necessary to open the facade 18.

Figure 5:
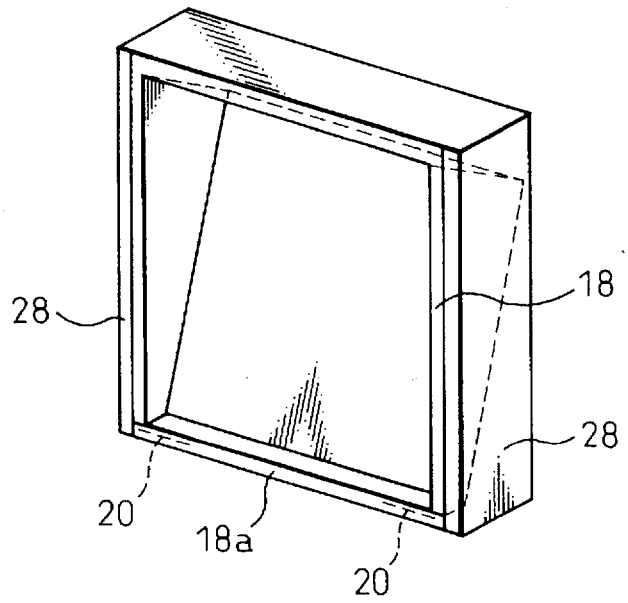
FIG. 5 is a perspective view of the facade and the front frame portion of the body of FIGS. 1 to 4.
Figure 6:
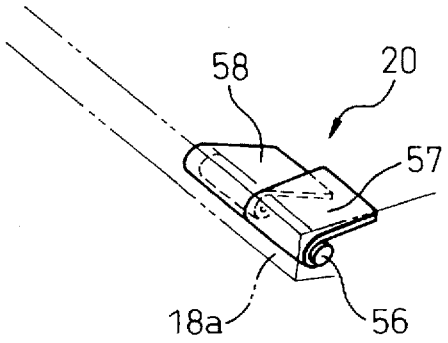
FIG. 6 is a perspective view of the hinge of FIGS. 1 and 5.
Figure 7:
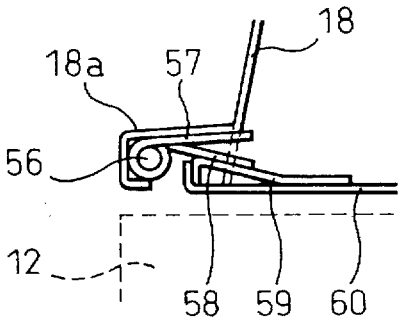
FIG. 7 is a side view of the hinge of FIG. 6.

FIGS. 5 to 7 show the hinge 20 arranged at the bottom of the facade 18 and of the side panels 28*a* of the front frame portion 28 of the body 16. The hinge 20 comprises a hinge pin 56, and (plural) first and (plural) second alternating hinge members 57 and 58 fitted on the hinge pin 56. Each first hinge member 57 is fixed to the facade 18, and each second hinge member 58 fixed to a tongue 59 fixed to a plate 60 which may be a horizontal bottom plate extending between the side panels 28*a* or a horizontal bottom plate extending directly from the body 16. The hinge 20 is located at a front, bottom position of the facade 18 and of the front frame portion. The facade 18 has a front, bottom wall 18*a* formed so as to surround the hinge 20, and the hinge 20 thus is not seen from the outside. Since the hinge 20 is located at a front, bottom position, the facade 18 can pivot with less interference with the wall 12. In addition, it is possible to arrange an annular outer frame 62 (FIG. 14) on the periphery of the aperture 14 in the wall 12, so as to leave a smaller clearance between the facade 18 and the wall 12 (or the outer frame 62) while allowing the pivotal motion of the facade 18.

Figure 8:
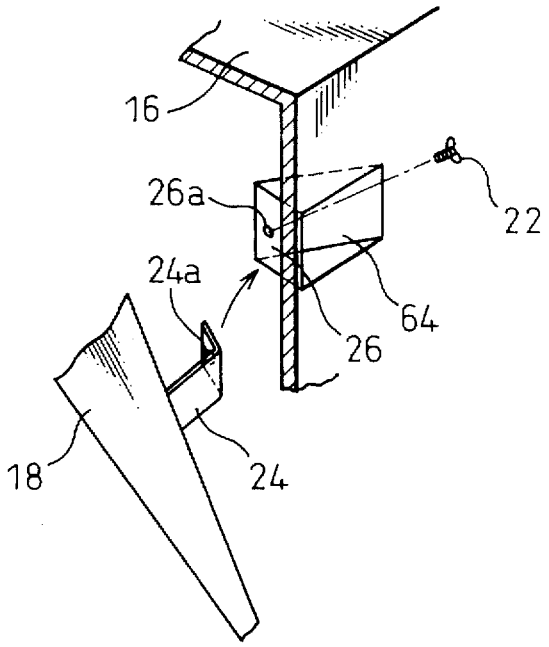
FIG. 8 is a diagrammatic perspective view of the facade and the body of the apparatus, illustrating locking means.
Figure 9:
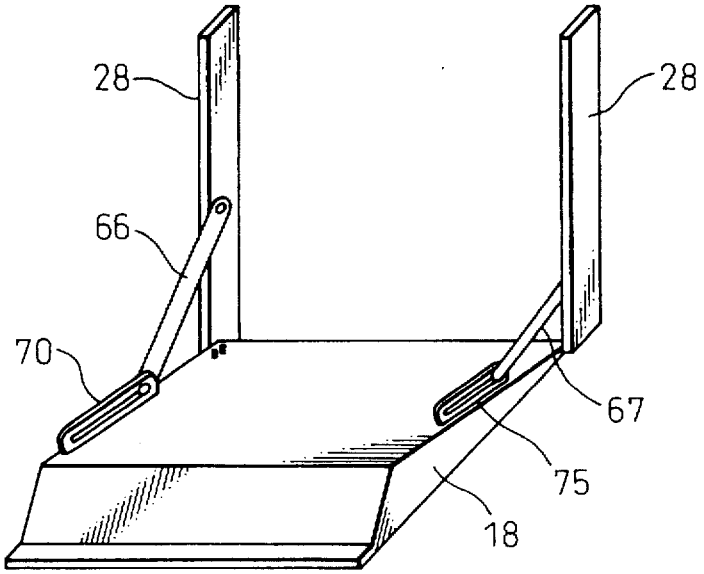
FIG. 9 is a diagrammatic perspective view of the facade and the front frame portion of the body, illustrating the support arms.
Figure 10:
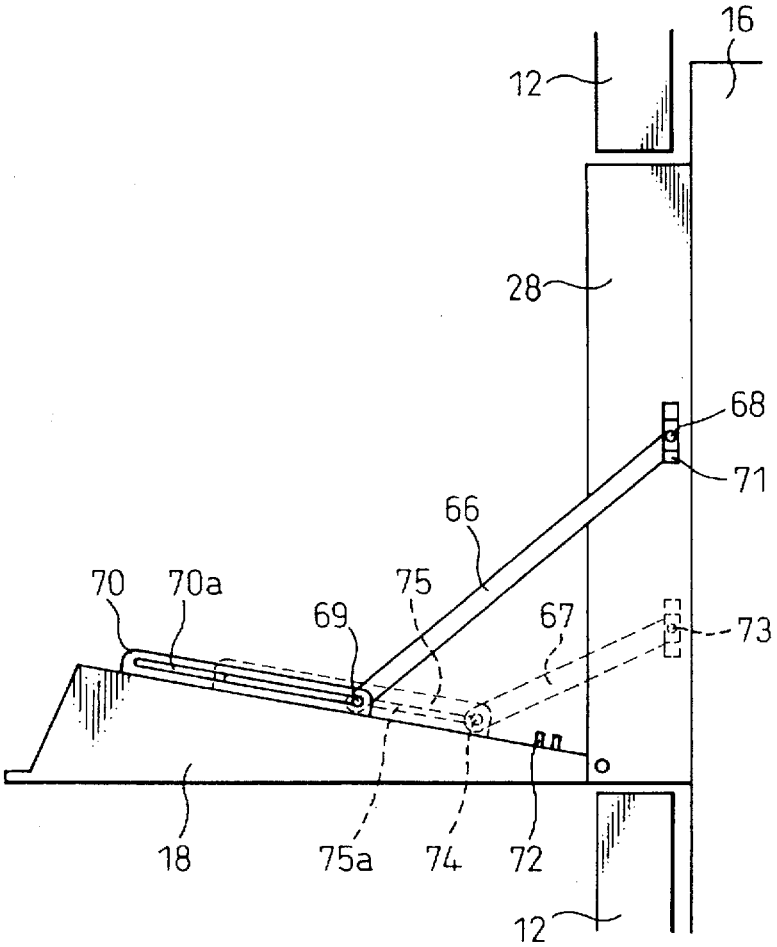
FIG. 10 is a cross-sectional view of the apparatus of FIG. 9, with the support arms in the open position.
Figure 11:
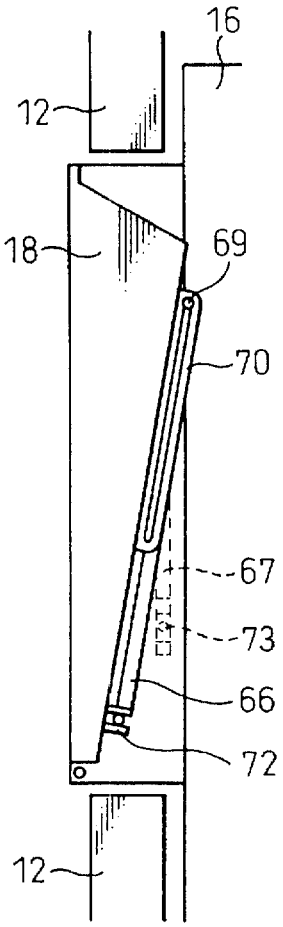
FIG. 11 is a cross-sectional view of the apparatus of FIG. 10, with the support arms in the closed position.
Figure 12:
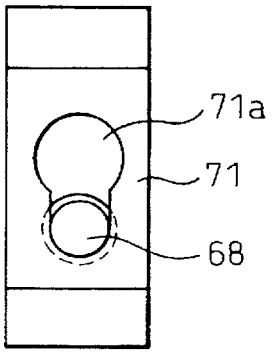
FIG. 12 is an enlarged front view of the anchor plate of FIG. 10.

FIG. 8 shows the lock in detail. The engaging member 24 is an L-shaped plate attached to the rear surface of the facade 18 and has a threaded hole 24*a*. The corresponding engaging member 26 is an outer wall portion of the body 16. The outer wall of the body 16 is pressed from the outside to the inside thereof to form a triangular cross-sectional recess 64, and the wall of the recess 64, corresponding to one side of the triangle, is the engaging member 26 having a through hole 26*a*. The engaging member 24 is brought into contact with the engaging member 26 when the facade 18 is closed, and the screw 22 can be placed in the recess 64 from the outside of the body 16. Since the screw 22 is located in the wall 12, it is not possible to open the facade 18 from the outside of the wall 12 when the apparatus 10 is in use. FIGS. 9 to 12 show support arms 66 and 67 extending between the sides of the facade 18 and the side panels 28*a* of the front frame portion of the body 16, respectively, for supporting the facade 18 in the open position. One support arm 66 is longer than the other support arm 67. The support arm 66 has at one end thereof a pivot pin 68 and at the other end thereof a pivot pin 69. The pivot pin 69 is slidably received in an elongated groove 70*a* of an attachment (i.e., channel) 70 which is fixed to the facade 18. The pivot pin 68 is releasably inserted in a hole 71*a* of an anchor plate 71 attached to the side panel 28*a*. The hole 71*a* of the anchor plate 71 has a large diameter portion and a small diameter portion, as shown in FIG. 12. When the facade 18 is in the open position, the pivot pin 68 is received in the small diameter portion of the hole 71*a* and thus extends between the facade 18 and the side panel 28*a* to support the facade 18. When the facade 18 is moved from the open position to the closed position, the pivot pin 68 is removed from the hole 71*a* via the large diameter portion thereof and held by a latch 72 arranged on the facade 18 while the other pivot pin 69 is moved to the far end of the groove 70*a*.

The shorter support arm 67 has at one end thereof a pivot pin 73 fixedly held at the other side panel 28 and at the other end thereof a pivot pin 74 which is slidably received in an elongated groove 75*a* of an attachment (i.e., channel) 75 fixed to the other side of the facade 18. The shorter support arm 67 as well as the longer support arm 66 can support the facade 18 in the open position. The longer the support arm is, the more reliably the support arm can support a load. However, the longer the support arm is, the more an operator is disturbed by the support arm when the acts on the components in the body 16 from the outside of the wall 12. Therefore, the longer support arm 66 is intended to support the facade 18 to a great proportion, and the shorter support arm 67 is intended to support the facade 18 to a small proportion but it can provide for an area for carrying out maintenance. That is, the operator can stand on the side of the shorter support arm 67 when the maintenance is carried out.

Figure 16:
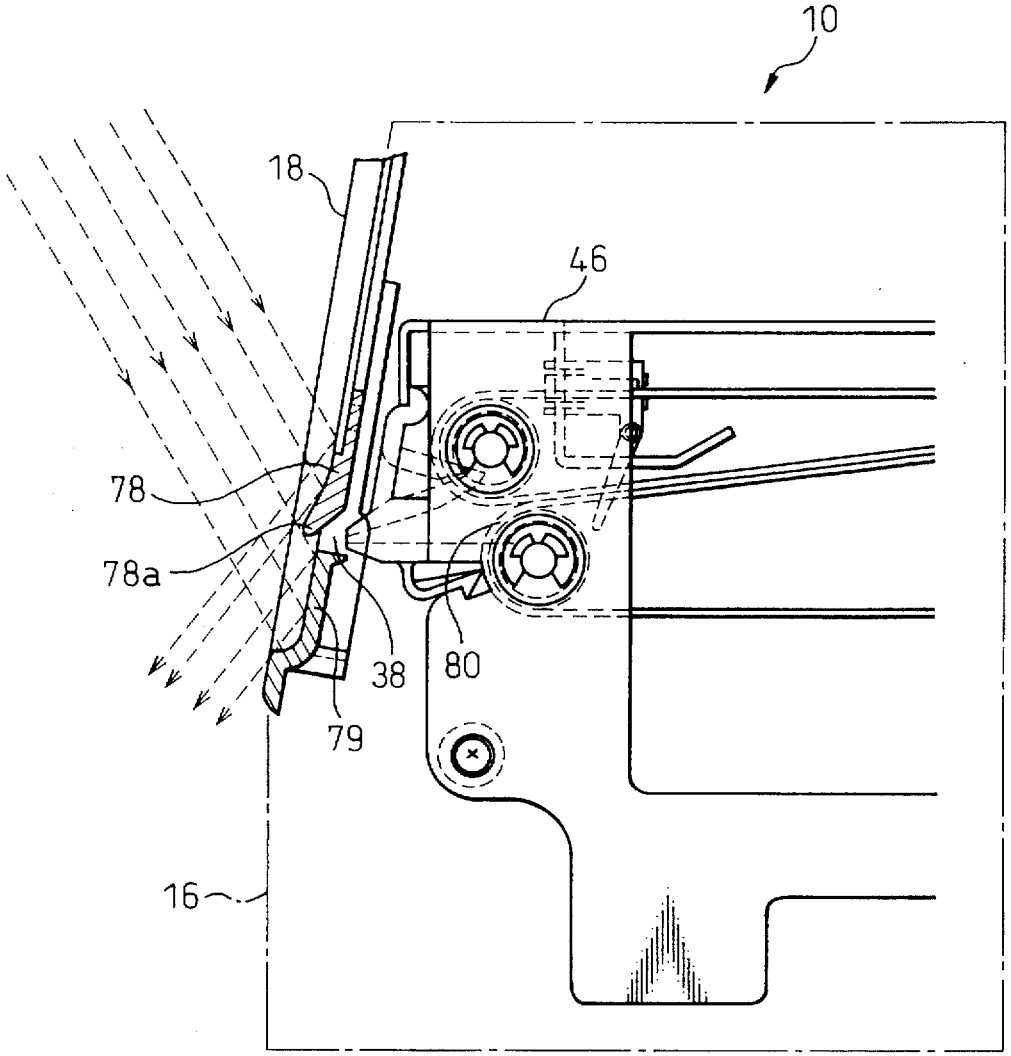
FIG. 16 is a diagrammatic cross-sectional view of the automatic customer service apparatus according to the second embodiment of the present invention.

FIG. 16 shows the second embodiment of the present invention. The facade.18 has a receipt outlet 38, as described with reference to FIG. 4, and the receipt outlet 38 in this embodiment is formed by parallel upper and lower wall members 78 and 29. The upper wall member 78 includes a jaw 78*a* at the bottom thereof, the jaw 78*a* extending obliquely outwardly, relatively to the lower wall member 79. The upper and lower wall members 78 and 79 can be integrally formed by plastic injection molding. It also is possible to form the upper and lower wall members 78 and 79 together with the facade 18 by injection molding. The body 16 of the apparatus 10 includes a receipt printer 46 and a receipt conveyor 80. Therefore, receipts are printed by the receipt printer 46 and conveyed by the receipt conveyor 80 to the receipt outlet 38.

If the body 16 of the through-wall type automatic customer service apparatus 10 is arranged in the outer wall 12 of a building structure so that the facade 18 is exposed to the outside of the building structure, the facade 18 is subjected to rain and snow, as shown by the arrows. However, rain or snow may not enter the receipt outlet 38 since the jaw 78*a* of the upper wall member 78 extends obliquely outwardly, relatively to the lower wall member 79. In addition, the inside of the body 16 cannot be readily seen from the outside of the facade 18 through the receipt outlet 38, and the receipt outlet 38 cannot be tampered with.

Figure 17:
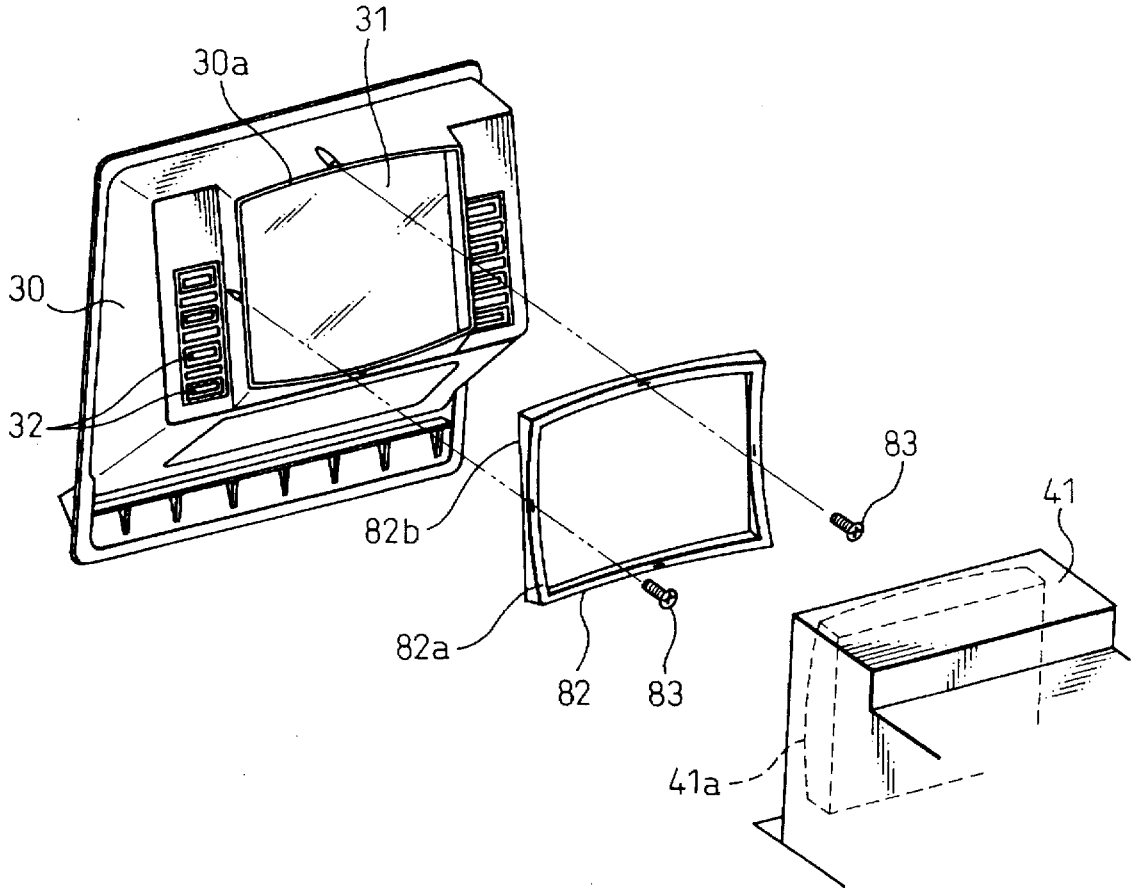
FIG. 17 is an exploded perspective view of the CRT display and the display panel according to the third embodiment of the present invention.
Figure 18:
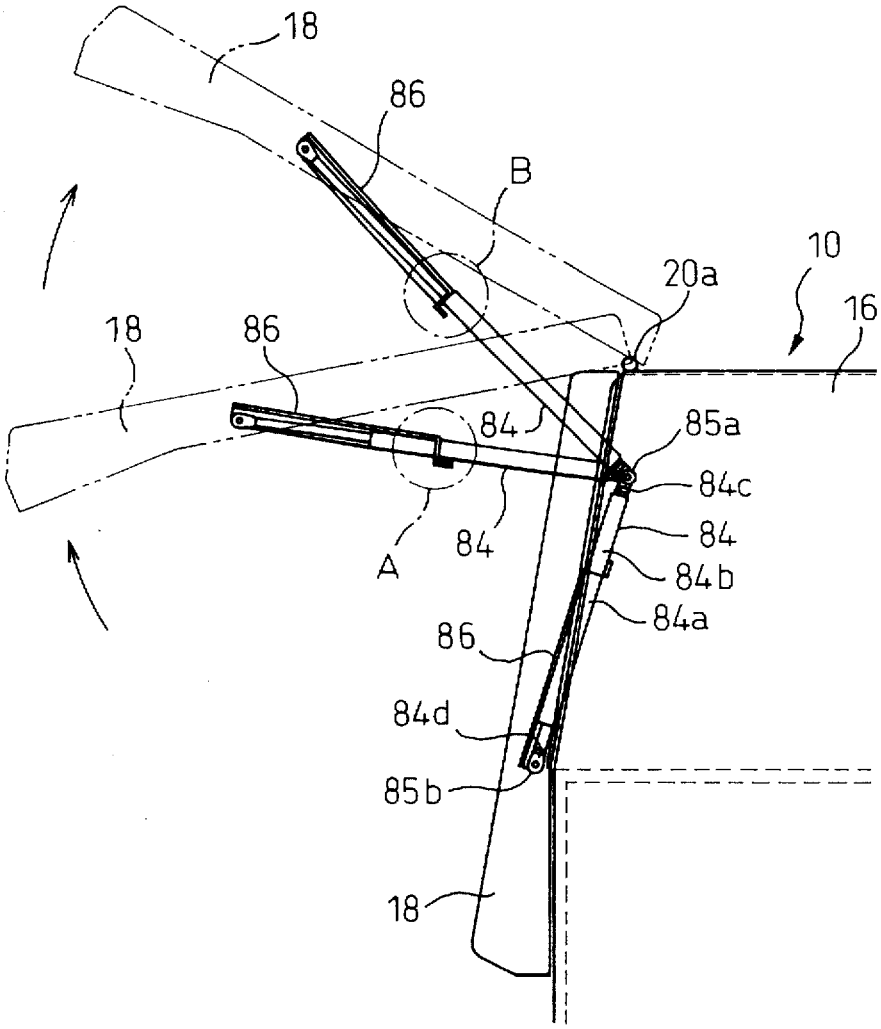
FIG. 18 is a diagrammatic side view of the automatic customer service apparatus according to the fourth embodiment of the present invention.
Figure 19:
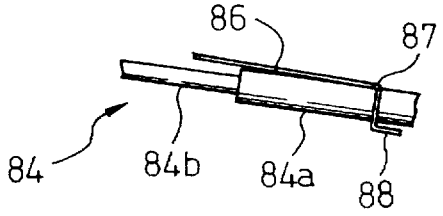
FIG. 19 is an enlarged view of the portion A of the gas spring in FIG. 18.

FIG. 17 shows the third embodiment of the present invention. The facade 18 has a display panel 30 having an opening 31 for a CRT display 41, small holes 32 for function keys and an opening 34 for a keyboard, as described with reference to FIG. 4. In this embodiment, an annular adapter 82 is interposed between the display surface 41*a* of the CRT display 41 and the display panel 30 so that the display panel 30 is urged to a peripheral region of the display surface 41*a* via the adapter 82. The rearwardly extending wall 30*a* surrounding the opening 31 is urged to (i.e. against) the adapter 82, and the adapter 82 is in turn urged to (i.e. against) the display surface 41*a*. The adapter 82 is fixed to the display panel 30 by screws 83.

Therefore, the peripheral region of the display surface 41*a* is hidden by the display panel 30 and the adapter 82, and accordingly, the display surface 41*a* can be seen from the outside of the display panel 30 but the inside of the body 16 cannot be seen.

The adapter 82 has a first surface 82*a* on the side of the CRT display 41 and a second surface 82*b* on the side of the display panel 30. The first surface 82*a* has a curvature identical to a curvature of the CRT display 41 to be used, and the second surface 82*b* has a curvature identical to a curvature of the display panel 30. Therefore, it is possible to apply the display panel 30 to the CRT display 41 even if the curvature of the display surface 41*a* of the CRT display 41 is different from the curvature of the display panel 30. Therefore, it is possible to use a standard display panel 30 with any of several different CRT displays 41 distributed by corresponding, several manufacturers.

FIGS. 18 to 26 show the fourth embodiment of the present invention. In this embodiment, the facade 18 is pivotably attached to the body 16 of the apparatus 10 about a horizontal hinge 20*a* arranged at the top of the facade 18. A gas spring (or gas springs 84) is are arranged between a side of the facade 18 and a side of the body 16 of the apparatus 10 for supporting the facade 18 in the open position. The gas spring 84 comprises a cylinder 84*a* containing gas therein and a rod 84*b* accommodated in and extendable from the cylinder 84*a*. One end 84*c* of the cylinder 84*a* is pivotably attached to the body 16 by a pivot pin 85*a* and the other end 84*d* of the rod 84*b* is pivotally attached to the facade 18 by a pivot pin 85*b*. Therefore, when the facade 18 is moved from the closed position to the open position, the rod 84*b* is extended from the cylinder 84*a* to support the facade 18 by the pressure of gas in the cylinder 84*a*.

A stopper 86 is incorporated with the gas spring 84 to lock the gas spring 84 in the open position. The stopper 86 is formed from a right-angled plate and has a hole 86*a* at one end thereof, the hole 86*a* being used to pivotally attach the stopper 86 to the pivot pin 84*b* along with the other end 84*d* of the rod 84*b*. The stopper 86 has a stop edge 87 at the end thereof opposite to the end at which the hole 86*a* is provided. The stopper 86 also has a return tab 88 arranged in such a manner that the cylinder 84*a* of the gas spring 84 is arranged between the stop edge 87 and the return tab 88.

Figure 20:
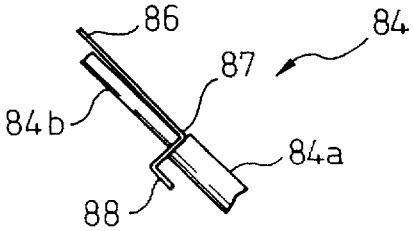
FIG. 20 is an enlarged view of the portion B of the gas spring in FIG. 18.
Figure 21:
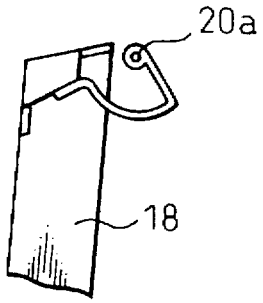
FIG. 21 is a side view of the facade of FIG. 18, illustrating the hinge.
Figure 22:
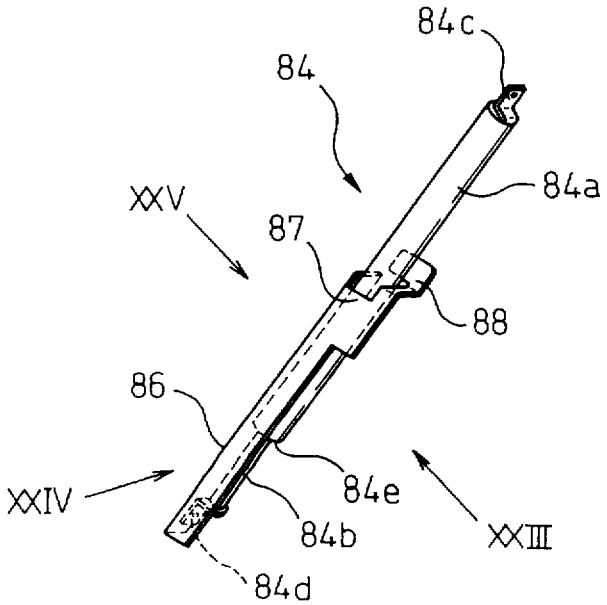
FIG. 22 is a perspective view of the gas spring with the stopper of FIG. 18.
Figure 23:
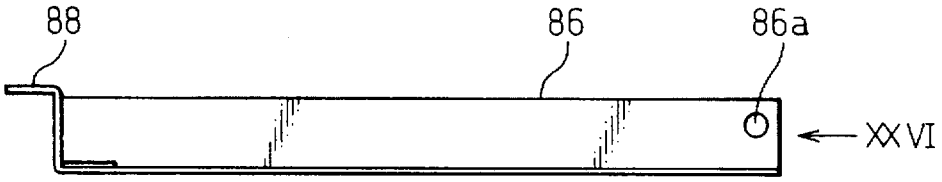
FIG. 23 is a side view of the gas spring, viewed in the direction of the arrow XXIII in FIG. 22.
Figure 24:
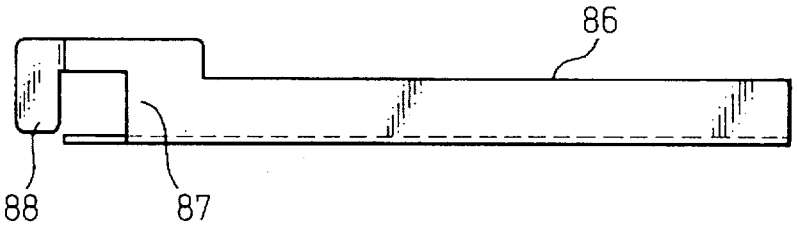
FIG. 24 is a front view of the gas spring, viewed in the direction of the arrow XXIV in FIG. 22.
Figure 25:
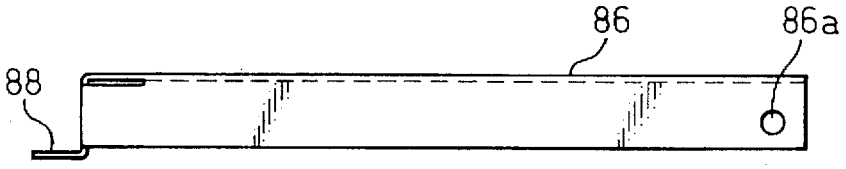
FIG. 25 is a side view of the gas spring, viewed in the direction of the arrow XXV in FIG. 22.
Figure 26:
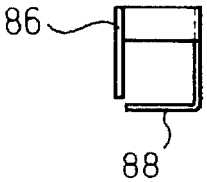
FIG. 26 is an end view of the gas spring, viewed in the direction of the arrow XXVI in FIG. 23.
Figure 1:
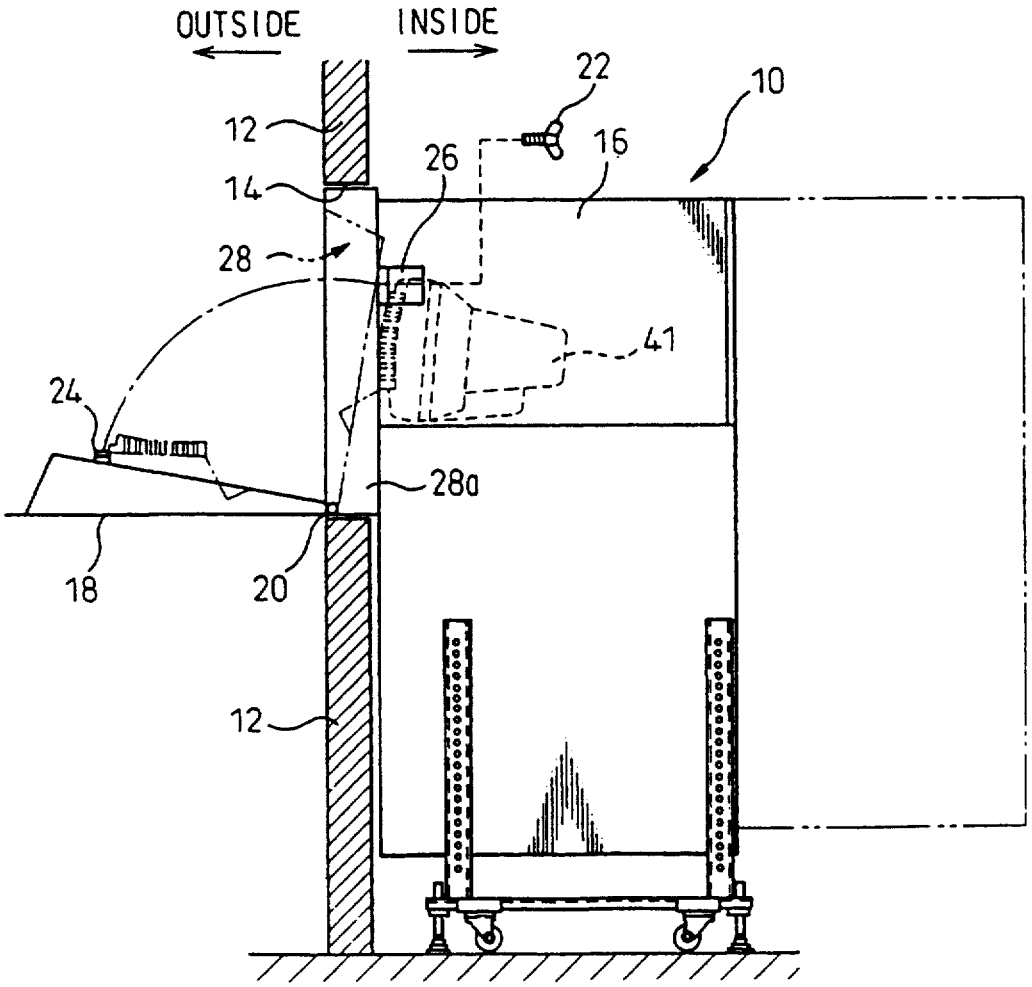
Figure 2:
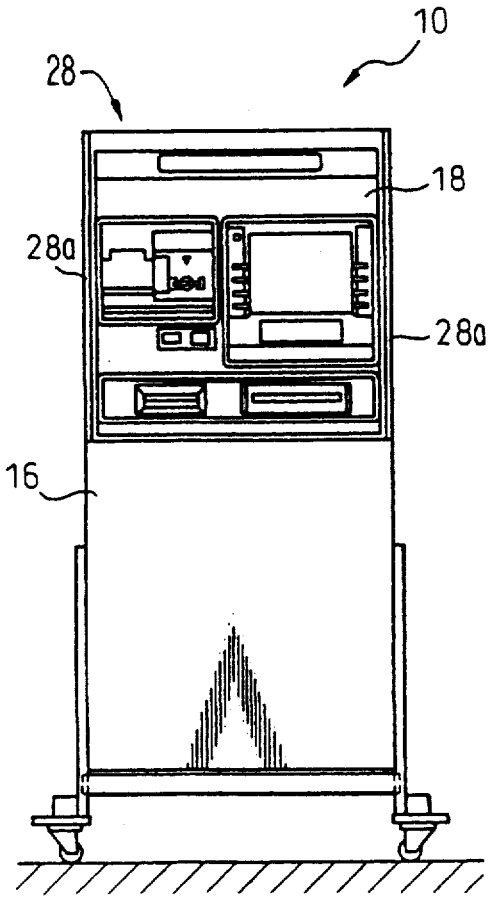
Figure 3:
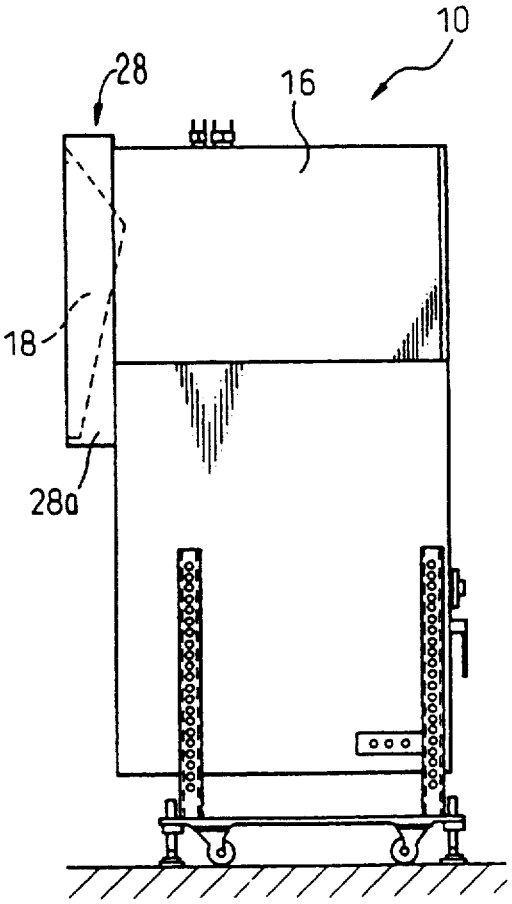
Figure 4:
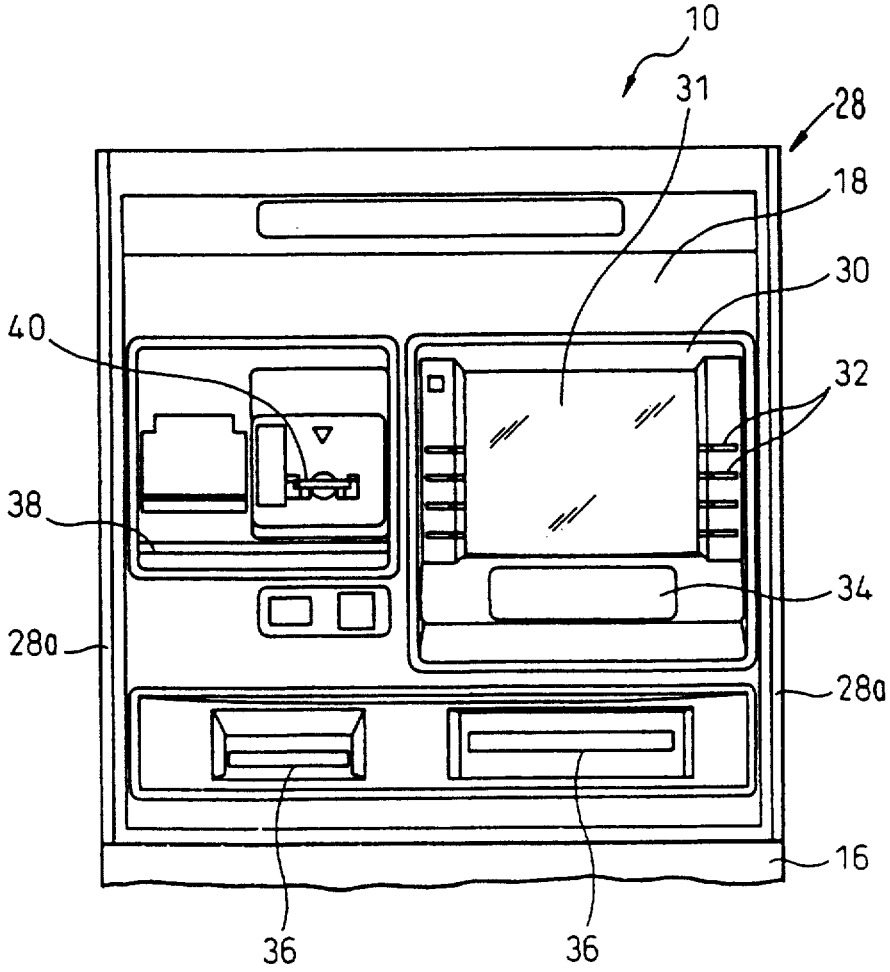
Figure 5:
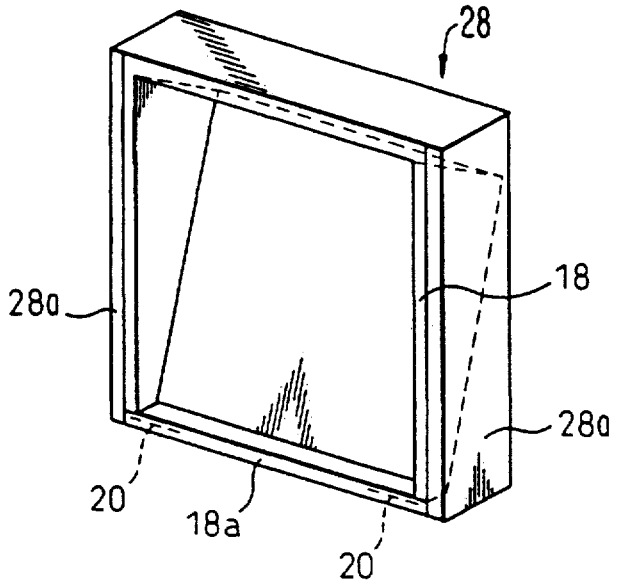
Figure 6:
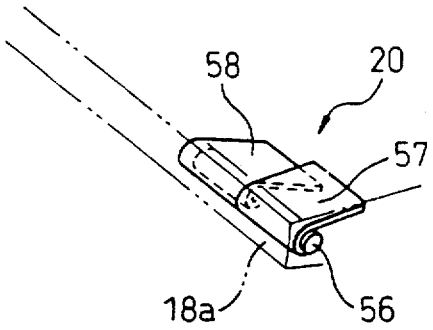
Figure 7:
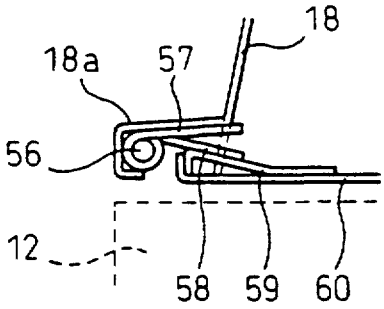
Figure 8:
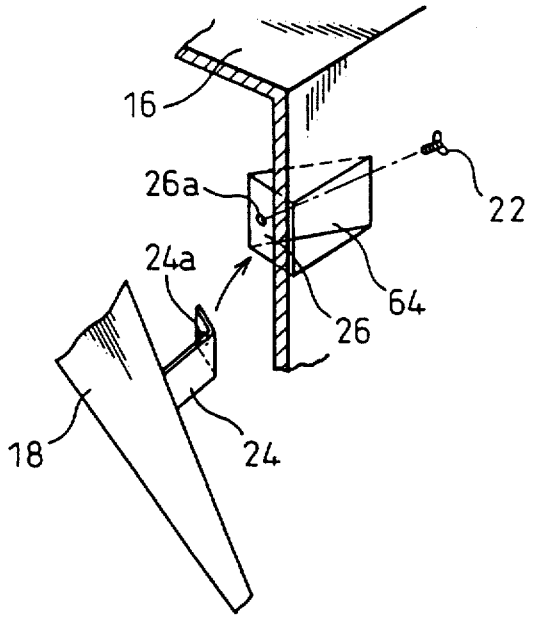
Figure 9:
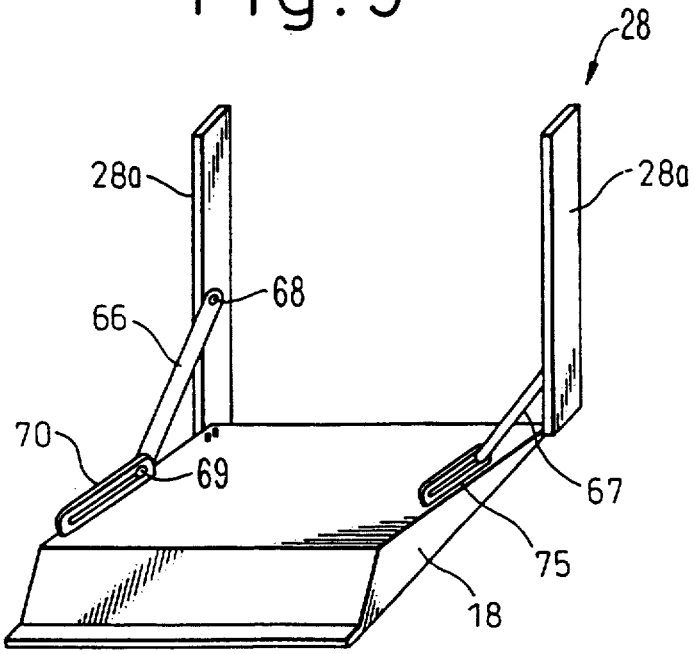
Figure 10:
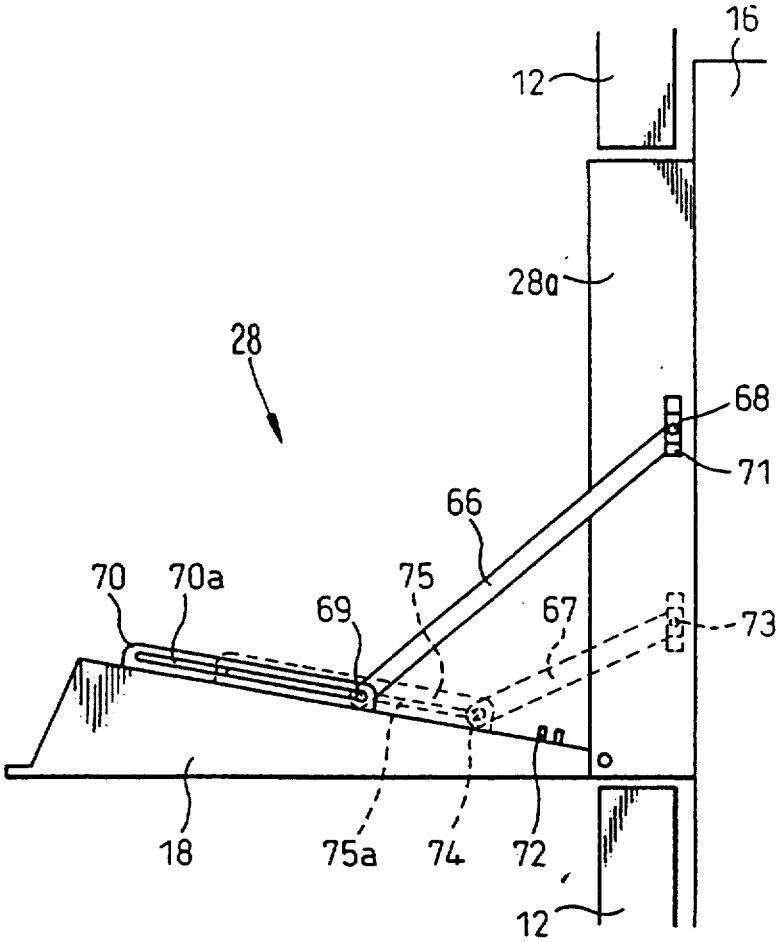
Figure 11:
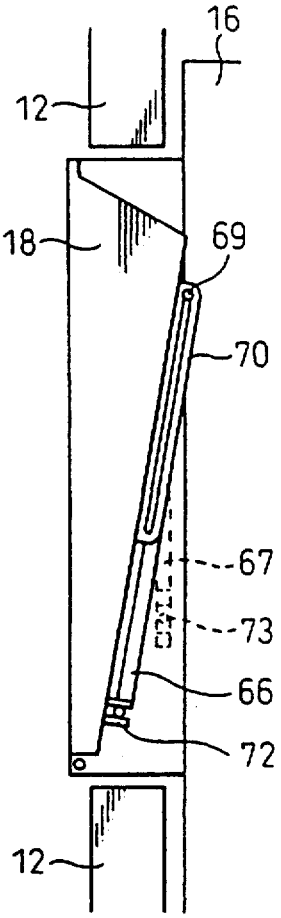
Figure 12:
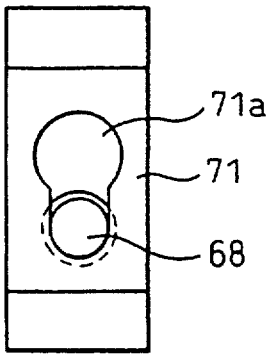
Figure 14:
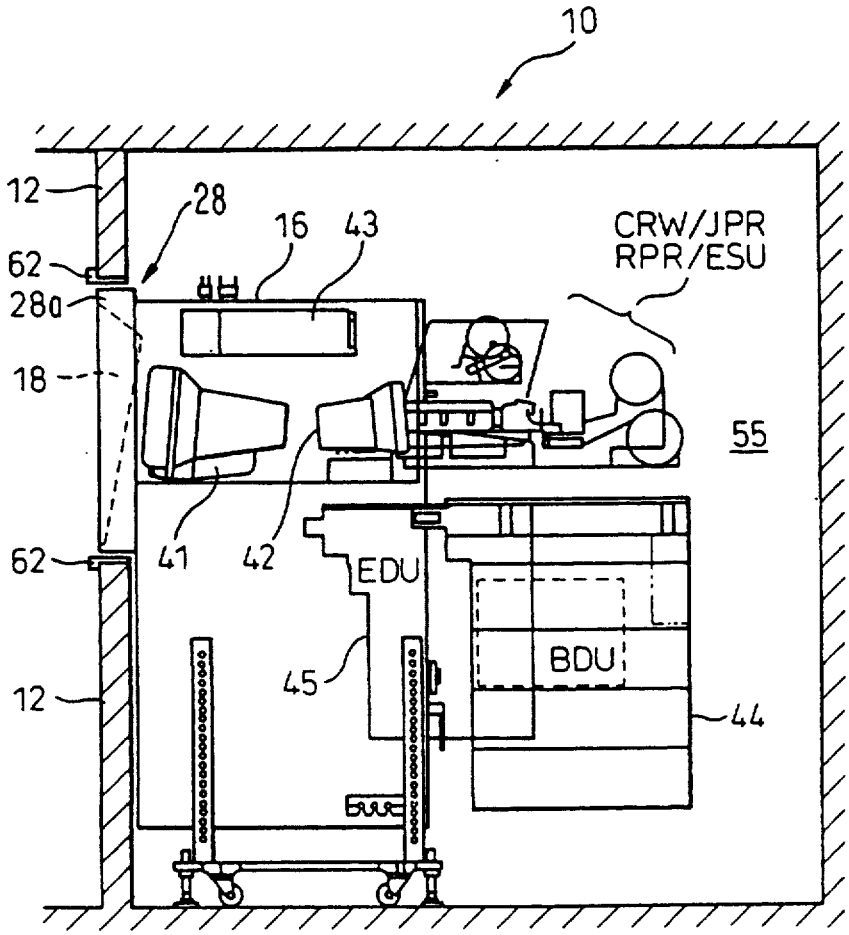
Figure 15:
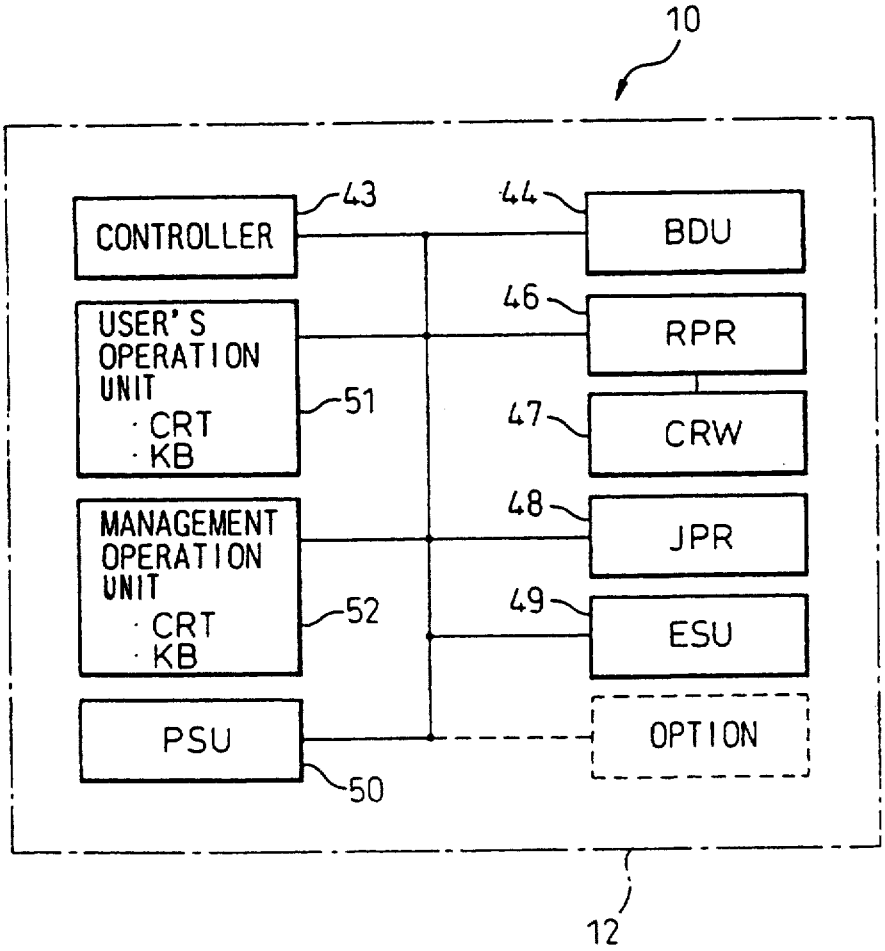

As the facade 18 is moved from the closed position to the open position, the gas spring 84 with the stopper 86 moves from the vertical position (FIG. 18), through the horizontal position (FIG. 19), to the inverted vertical position (FIG. 20). When the facade 18 is moved to the open position, the rod 84*b* of the gas spring 84 is fully extended from the cylinder 84*a* and the stop edge 87 drops from the cylinder 84*a* to the rod 84*b* to engage with the end face of the cylinder 84*a*. Accordingly, the gas spring 84 is locked by the stopper 86 when the facade 18 is in the open position, and the facade 18 is maintained in the open position even if the function of the gas spring 84 declines. When the facade 18 is moved from the open position to the closed position, the return tab 88 is pushed to lift the stop edge 87 from the cylinder 84*a*.

We claim:

1. A through-wall type automatic customer service apparatus for positioning in a building structure defined at least in part by a substantially upright wall which separates an interior of the building structure from an exterior of the building structure, the wall having corresponding inside and outside surfaces and an aperture extending therethrough, comprising:

a body having front and rear surfaces defining an interior of the body in which mechanical and electrical components are disposed and comprising a front frame portion protruding outwardly from the front surface, surrounding and defining an opening therethrough providing access to the interior of the body, and a facade mounted to the front frame portion for selective pivotal movement about a substantially horizontal axis between a closed position, substantially upright and covering the opening, and an open position, protruding outwardly from the front surface of the body and through the opening;

said body being adapted for positioning the front surface thereof contiguous the inside surface of the wall so that the facade is exposed to the exterior of the building structure through the aperture in the wall thereby to render the apparatus accessible for operation by users from the exterior of the building structure, said facade, in the open position thereof, protruding outwardly from the front surface of the body and through the aperture, exposing the interior of the body and providing access, from the exterior of the building structure, to at least selected mechanical and electrical components disposed in the interior of the body, and, in the closed position thereof, at least a portion of the facade being disposed within the aperture of the wall and blocking access to the interior of the body from the exterior of the building structure; and a lock selectively locking the facade, in the upright position thereof, to the body.

2. An automatic customer service apparatus according to claim 1, further comprising:

a generally horizontal hinge defining the horizontal axis and pivotally connecting a bottom end of said facade to the front frame portion of the body.

3. An automatic customer service apparatus according to claim 2, wherein the lock is disposed relatively to the body so as to be operable from a position outside of said body and inside the building structure.

4. An automatic customer service apparatus according to claim 3, wherein the lock further comprises:

a first engaging member attached to the facade;

a corresponding, second engaging member attached to the front frame portion of the body; and a screw connecting the corresponding, first and second engaging members.

5. An automatic customer service apparatus according to claim 2, wherein the facade is pivotally attached at a lower end thereof to the front frame portion of the body.

6. An automatic customer service apparatus according to claim 1, wherein said facade is pivotally attached at an upper end thereof to the front frame portion of the body.

7. An automatic customer service apparatus according to claim 2, wherein:

said facade comprises a top, a pair of spaced, first and second opposite sides and a bottom; and said front frame portion comprises a pair of vertically extending, opposite side panels spaced by the opening and between which said facade extends, said side panels corresponding in size to, and being adapted for insertion into, the aperture of the wall so as to position at least the portion of said facade, in the closed position thereof, within the aperture.

8. An automatic customer service apparatus according to claim 7, wherein said hinge is located at respective and corresponding front, bottom positions of the facade and the front frame portion.

9. An automatic customer service apparatus according to claim 8, wherein said facade has a front, bottom wall extension which surrounds the hinge.

10. An automatic customer service apparatus according to claim 7, further comprising first and second support arms respectively extending between the first and second sides of the facade and the corresponding side panels of the front frame portion of the body for supporting the facade in the open position.

11. An automatic customer service apparatus according to claim 10, wherein said first and second support arms are of first and second, respective and different lengths.

12. An automatic customer service apparatus according to claim 1, wherein said body houses a receipt printer and a receipt conveyor and said facade has a receipt outlet for outputting a receipt, printed by said receipt printer and conveyed by said receipt conveyor, said receipt outlet being formed by parallel upper and lower wall members, said upper wall member including a jaw at the bottom thereof and said jaw extending obliquely outwardly, relatively to the lower wall member.

13. An automatic customer service apparatus according to claim 1, wherein:

said body houses a CRT display having a display surface;

said facade comprises a display panel having an opening therein; and an annular adapter is interposed between the display surface and the display panel so that the display panel is urged to a peripheral region of the display surface via the adapter.

14. An automatic customer service apparatus according to claim 13, wherein said adapter has a first surface on the side of the CRT display and a second surface on the side of the display panel, the first surface having a first curvature substantially identical to a curvature of the CRT display to be used and the second surface having a second curvature substantially identical to a curvature of the display panel.

15. An automatic customer service apparatus according to claim 6, further comprising at least one gas spring extending between and interconnecting a side of the facade and a respective side of the body for supporting the facade in the open position, said gas spring comprising a cylinder and a rod accommodated in and extendable from the cylinder.

16. An automatic customer service apparatus according to claim 15, wherein said gas spring includes a stopper which is operable to lock the gas spring in the open position.

17. An automatic customer service apparatus according to claim 16, wherein:

said cylinder of the gas spring is located higher than the extended rod when in the open position, and said stopper further comprises an engaging portion which engages a lower end of the cylinder when in the open position and releasing means for releasing said engagement.

18. A through-wall type automatic customer service apparatus, comprising:

a body having front and rear surfaces and spaced side surfaces surrounding and defining an interior of the body, in which mechanical and electrical components are received and mounted, and a facade pivotally mounted to the body, adjacent the front surface of the body, for selective, pivotal movement about a substantially horizontal axis between a closed, upright position covering an access opening in the front surface of the body and an open position extending outwardly beyond, and generally transversely to, the front surface of the body thereby to expose and render accessible, through the access opening in the front surface of the body, at least selected said mechanical and electrical components;

at least one of the mechanical and electrical components mounted in the interior of the body having a keyboard operable by a user of the apparatus, the keyboard projecting from the interior and beyond the front surface of the body so as to be accessible at the exterior of the body and the facade, further, having a keyboard opening therein through which, in the closed position of the facade, the keyboard is received and projects and thereby is accessible to the user at the exterior of the body;

the facade, in the closed, upright position, having an exterior surface lying in a plane displaced outwardly from the front surface of the body so as to project into, and substantially fill, an aperture in a wall having an interior surface contiguous to the front surface of the body, the facade, in the closed, upright position thereof, blocking access to the interior of the body and, in the open position thereof, projecting through the aperture for uncovering the access opening and permitting access therethrough to at least selected said mechanical and electrical components; and a lock for selectively locking the facade to the body in the closed position of the facade, the lock being displaced from and accessible from a position remote from the front surface of the body and the contiguous interior surface of the wall.

19. An automatic customer service apparatus according to claim 18, further comprising:

a generally horizontal hinge vertically connecting a selected one of an upper edge and a lower edge of the facade to the front frame portion of the body.

20. An automatic customer service apparatus according to claim 18, further comprising first and second support arms respectively extending between first and second sides of the facade and corresponding side panels of the front frame portion of the body and supporting the facade in the open position.

21. An automatic customer service apparatus according to claim 20, wherein said first and second support arms are of first and second, respective and different lengths.

22. An automatic customer service apparatus according to claim 18, wherein said body houses a receipt printer and a receipt conveyor and said facade has a receipt outlet for outputting a receipt, printed by said receipt printer and conveyed by said receipt conveyor, said receipt outlet being formed by parallel upper and lower wall members, said upper wall member including a jaw at the bottom thereof and said jaw extending obliquely outwardly, relatively to the lower wall member.

23. An automatic customer service apparatus according to claim 18, wherein:

said body houses a CRT display having a display surface;

said facade comprises a display panel having an opening therein; and an annular adapter is interposed between the display surface and the display panel so that the display panel is urged to a peripheral region of the display surface via the adapter.

24. An automatic customer service apparatus according to claim 23, wherein said adapter has a first surface on the side of the CRT display and a second surface on the side of the display panel, the first surface having a first curvature substantially identical to a curvature of the CRT display to be used and the second surface having a second curvature substantially identical to a curvature of the display panel.

25. An automatic customer service apparatus according to claim 18, further comprising at least one gas spring extending between and interconnecting a side of the facade and a respective side of the body for supporting the facade in the open position, said gas spring comprising a cylinder and a rod accommodated in and-extendable from the cylinder.

26. An automatic customer service apparatus according to claim 25, wherein said gas spring includes a stopper which is operable to lock the gas spring in the open position.

27. An automatic customer service apparatus according to claim 26, wherein:

said cylinder of the gas spring is located higher than the extended rod when in the open position, and said stopper further comprises an engaging portion which engages a lower end of the cylinder when in the open position and releasing means for releasing said engagement.

28. An automatic customer service apparatus according to claim 18, wherein at least selected ones of the rear and side surfaces of the body have permanently open portions providing access to the interior of the body.

* * * * *

UNITED STATES PATENT AND TRADEMARK OFFICE

CERTIFICATE OF CORRECTION

PATENT NO. : 5,740,744

DATED : Apr. 21, 1998

INVENTOR(S) : NASHIROZAWA et al.

It is certified that error appears in the above-identified patent and that said Letters Patent is hereby corrected as shown below:

The title page, should be deleted to appear as per attached title page.

Replace Sheets 1 of 14 through 6 of 14, 8 of 14 and 9 of 14 (Figs. 1-12, 14 and 15) of the drawings with the attached, correct drawings.

Col. 1, line 19, after "wall" insert --,--.

Col. 6, line 19, begin a new paragraph with "FIGS. 9 to 12";
line 30, change "28aa" with --28a--;
line 63, change "29" to --79--.

Col. 7, line 27, after "i.e." insert --,--;
line 28, after "i.e." insert --,--;
line 53, change "is are" to --is (are)--.

Col. 12, line 10 (Claim 25, line 6), change "and-extendable" to --and extendable--.

Signed and Sealed this

Twenty-seventh Day of October, 1998

*Attest:*

Bruce Lehman

BRUCE LEHMAN

*Attesting Officer*

*Commissioner of Patents and Trademarks*

United States Patent [19]

Nashirozawa et al.

[11] Patent Number: 5,740,744

[45] Date of Patent: Apr. 21, 1998

[54] THROUGH-WALL TYPE AUTOMATIC CUSTOMER SERVICE APPARATUS

[75] Inventors: Kenichi Nashirozawa; Michinori Kawano; Kazushi Watari; Shuetsu Oikawa; Hiroyuki Moto; Setsuko Yamamoto, all of Kawasaki, Japan

[73] Assignee: Fujitsu Limited, Kawasaki, Japan

[21] Appl. No.: 506,771

[22] Filed: Jul. 26, 1995

[30] Foreign Application Priority Data

| | | | |
|---|---|---|---|
| Nov. 29, 1994 | [JP] | Japan | 6-294284 |
| Nov. 29, 1994 | [JP] | Japan | 6-294285 |
| Nov. 29, 1994 | [JP] | Japan | 6-294286 |
| Nov. 29, 1994 | [JP] | Japan | 6-294287 |

[51] Int. Cl.[6] ..... G07H 9/00

[52] U.S. Cl. ..... 109/24.001; 235/379; 902/30

[58] Field of Search ..... 109/24.1; 235/379; 902/30–36

[56] References Cited

U.S. PATENT DOCUMENTS

| | | | |
|---|---|---|---|
| 2,897,534 | 8/1959 | Pickerell | 292/263 |
| 3,064,846 | 11/1962 | Thomas | 292/263 |
| 3,480,247 | 11/1969 | Waner | 292/275 |
| 4,595,828 | 6/1986 | Lundblad | 235/379 |
| 5,017,026 | 5/1991 | Takesako et al. | 235/379 |
| 5,024,073 | 6/1991 | Lloyd | 70/34 |
| 5,071,180 | 12/1991 | Wiedehage et al. | 292/268 |
| 5,222,445 | 6/1993 | Capraro | 109/24.1 |
| 5,299,511 | 4/1994 | Dallman et al. | 109/24.1 |
| 5,483,047 | 1/1996 | Ramachandran et al. | 235/379 |
| 5,553,552 | 9/1996 | Bauer et al. | 109/24.1 |

FOREIGN PATENT DOCUMENTS

| | | | |
|---|---|---|---|
| 2812894 | 10/1979 | Germany | 292/268 |

*Primary Examiner*—Darnell M. Boucher

*Attorney, Agent, or Firm*—Staas & Halsey

[57] ABSTRACT

A through-wall type automatic customer service apparatus is arranged in a partition wall in a financial institution. The body of the apparatus has a facade which passes through an aperture in the wall and is exposed to the outside of the wall, for operation by users. The facade is pivotably attached to the body and is movable between an open position and a closed position. A locking screw can lock the facade in the closed position and can be operated from the outside of the body in the wall. The apparatus also includes support arms for supporting the facade in the open position.

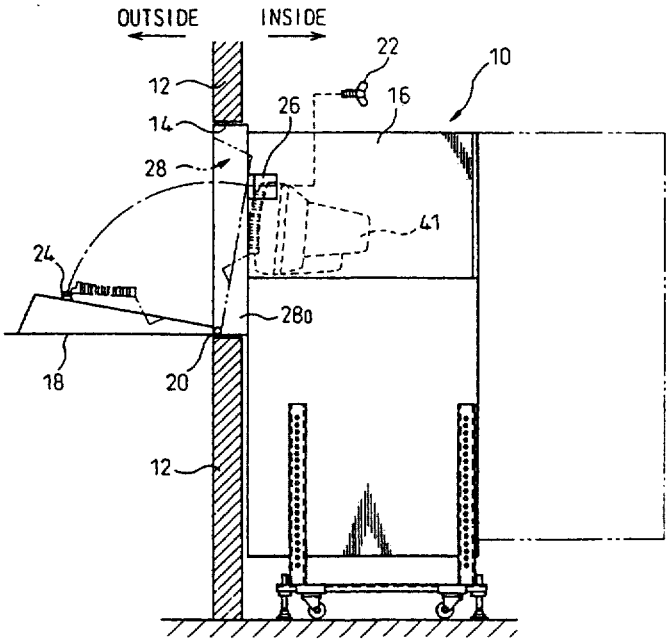

28 Claims, 14 Drawing Sheets